United States Patent [19]

Steen

[11] 4,074,099

[45] Feb. 14, 1978

[54] COAXIAL, POLARITY-REVERSING SWITCH

[75] Inventor: Donald B. Steen, Bowie, Md.

[73] Assignee: The United States of America as represented by the Secretary of the Navy, Washington, D.C.

[21] Appl. No.: 754,282

[22] Filed: Dec. 27, 1976

[51] Int. Cl.[2] ..... H01H 3/24; H01H 15/06

[52] U.S. Cl. ..... 200/153 S; 200/1 V; 200/82 R; 200/163; 200/252

[58] Field of Search ..... 200/1 V, 82 R, 82 B, 200/51 R, 51.07, 153 S, 163, 164 R, 252; 333/97 S

[56] References Cited

U.S. PATENT DOCUMENTS

| | | | |
|---|---|---|---|
| 2,429,401 | 10/1947 | Davis | 200/4 X |
| 2,550,921 | 5/1951 | Greene | 333/97 S X |
| 3,036,282 | 5/1962 | Lanctot | 200/153 S X |
| 3,078,354 | 2/1963 | Pettit, Jr. et al | 200/1 R X |
| 3,080,539 | 3/1963 | Brennan | 333/97 S X |
| 3,087,125 | 4/1963 | Scholefield | 333/97 S X |
| 3,374,449 | 3/1968 | Moore et al. | 333/97 S |
| 3,553,608 | 1/1971 | Mison | 333/97 S X |
| 3,703,621 | 11/1972 | Viola et al. | 200/1 V X |
| 3,800,103 | 3/1974 | Härdi-Kern et al. | 200/163 X |
| 3,941,957 | 3/1976 | Tilman | 200/252 |

*Primary Examiner*—Stephen Marcus

*Attorney, Agent, or Firm*—R. S. Sciascia; Q. E. Hodges

[57] ABSTRACT

A coaxial, polarity-reversing switch for insertion and electrical connection into a coaxial power transmission line with both switch and line designed for carrying high direct current, but useable with alternating current systems. Since stray or external magnetic fields are best contained in coaxial transmission lines, this coaxial switch best maintains this desired relationship. A reciprocatable shuttle, movable axially within the body of the switch, has multi-louvered contact material containing many areas of contact to conduct the high current. In one shuttle position the switch maintains forward polarity; in the central position, the switch is off; in a third position, the polarity of the conductors in the coaxial line is reversed. Thus the switch is a DPDT center-off type, non-conductive coolant may be circulated through passages in the switch and when used may be sealed in the switch with suitable seals.

11 Claims, 4 Drawing Figures

FORWARD POLARITY

OFF

REVERSE POLARITY

COAXIAL, POLARITY-REVERSING SWITCH

The invention described herein may be manufactured and used by or for the Government of the United States of America for governmental purposes without the payment of any royalties thereon or therefor.

BACKGROUND OF THE INVENTION

This invention relates to electrical switches, and more particularly to a coaxial switch for insertion and electrical connection into a coaxial transmission line. The switch is designed to carrying high current, and to minimize the production of stray magnetic fields.

Direct current transmission systems, whether they be for superconducting machines, welding, or power distribution, generally produce large stray magnetic fields caused by the current passing through the conductors. These fields have many detrimental manifestations. One problem is that when parallel conductors are closely spaced they must normally be tightly secured to preclude the occurrence of adverse effects associated with the attraction and replusion effects produced by the magnetic fields associated with the flow of current. Another problem is the generation of stray magnetic field, which may be detrimental to other equipment; and which, when aboard ship, may be capable of enemy detection and may cause the activation of magnetic mines and/or torpedoes.

One of the best ways of eliminating or minimizing the effect of these stray magnetic fields is to transmit the current through a coaxial transmission line, which produces no external field due to the fact that the magnetic fields produced by the current in each conductor cancels that produced by the other. Where it is only desired to reverse polarity, or to merely switch the current distribution without concern for magnetic effect, prior art conventional switch-gear has been used. But such conventional switch-gear when used with a coaxial line, presents complex design problems, such as the transitional connection between the coaxial cable and the switch. The most important problem is that once the coaxial line feature is interrupted, stray magnetic fields are produced from the non-coaxial conductors within the switch and the leads thereto. Therefore in situations where such magnetic fields are detrimental, complex shielding means have to be used.

Coaxial switches in the prior art have been used for many years, particularly in radio antenna switching networks, but such switches do not usually carry high currents. In addition, one feature of this invention that is absent from practically all coaxial switches in the prior art, is the switching of current in both the inner conductor and the outer conductor or shield element. Totally non-existent in the prior art seems to be the feature of polarity reversal in coaxial switches; that is, connecting the center conductor to the shield, and connecting the shield to the center conductor when the switch is inserted between the ends of a coaxial cable.

SUMMARY OF THE INVENTION

Briefly, the instant invention overcomes the disadvantages of the prior art coaxial switches by providing a coaxial, polarity-reversing switch, that is insertable into a coaxial power transmission line, and that continues to best-contain the stray magnetic fields without complex switch-gear and shielding. The switch can switch without load current, and then carry load currents up to 30,000 amperes. It is used primarily for polarity reversal; that is, positive direct current enters on the inner conductor, and exits on the outer conductor; negative direct current enters on the outer conductor and exits on the inner conductor. The switch has an "off" position, and a non-reversing or forward polarity position, thus making it a double-pole, double throw (DPDT), center "off" type switch. A reciprocating shuttle, provided to perform the switching operation is movable axially within the body of the switch, and is made up of conductive and insulative materials for carrying current to and from the inner and outer conductors respectively. Multi-louvered ("Multi-lam") multi-contact material is used at each movable contact and coaxial line connection to conduct high current and keep contact resistance low. Non-conductive coolant fluid may be circulated through passages in the switch and line to remove $I^2R$ heat build up.

The coaxial transmission line may be made of economical and light aluminum, and the inner and outer conductors thereof may be spaced from each other by longitudinal strips of insulative material to allow the flow of a non-conductive coolant between the conductors. The conductors are gripped at their ends by concentric sleeves in the switch with "multilam" mounted in the sleeves. Provision is made within the switch to allow for longitudinal expansion of the switch and the transmission line due to heat. This construction permits the switch to be easily plugged into and out of the coaxial transmission line. The reciprocating shuttle's conductor may be made up of copper for better conductivity thus allowing the use of conductors having smaller cross-section for a given current capacity than would the use of aluminum. The smaller conductors also facilitate the insulation within the switch without unduly increasing its bulk.

STATEMENT OF THE OBJECTS OF THE INVENTION

Accordingly, an object of the invention is to provide a new, improved, and efficient coaxial, switch.

Another object of the instant invention is to provide a coaxial, polarity-reversing switch for insertion into coaxial electrical transmission lines.

Still another object of the present invention is to provide a coaxial switch for coaxial transmission lines that will contain and thereby eliminate stray magnetic fields.

A further object of the instant invention is to provide a coaxial switch for coaxial lines capable of switching the current load between the outer conductor shield and the inner conductor.

A still further object of the present invention is to provide a coaxial polarity-reversing switch that will carry very high currents, without significant $I^2R$ heat losses.

Another object of the instant invention is to provide a coaxial switch that seals the interior of the switch and coaxial lines for containing a coolant fluid that prevents corrosion from outside elements.

A further object of the present invention is to provide a plug-in coaxial switch which allows axial movement for expansion of the coaxial line.

BRIEF DESCRIPTION OF THE DRAWINGS

Other objects, advantages, and novel features of the invention will become apparent from the following detailed description of the invention when considered in conjunction with the accompanying drawings wherein.

DESCRIPTION AND OPERATION OF THE PREFERRED EMBODIMENT

Figure 1:
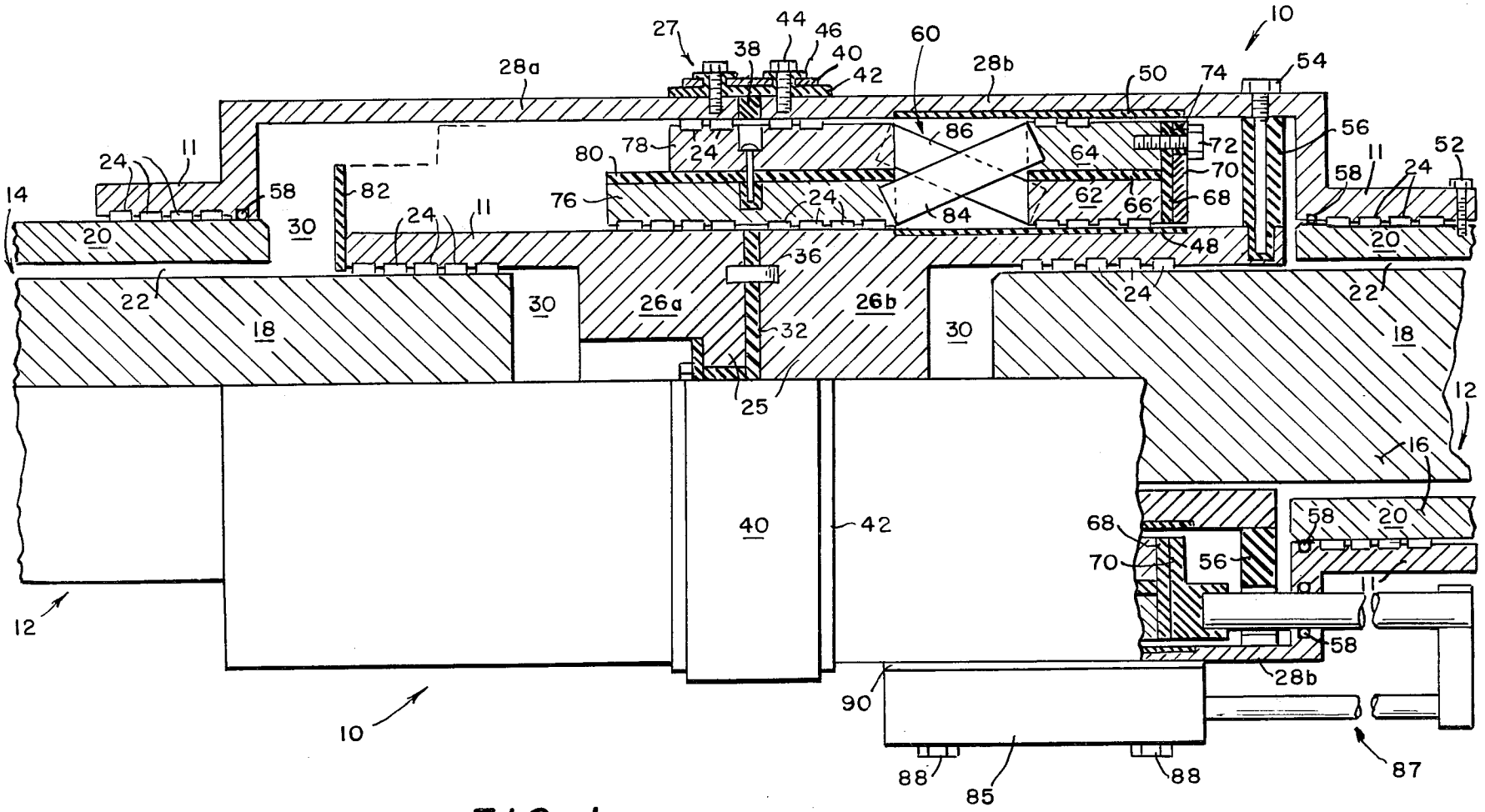
FIG. 1 is a front, partially cut-away, view of the coaxial switch inserted into a coaxial transmission line.

Referring now to the drawings, wherein like reference numerals refer to same part throughout the several views, there is shown generally in FIG. 1, a coaxial switch 10 inserted into a coaxial transmission line 12. To allow for the switch insertion, the coaxial line 12 has separated, opposing, and uniaxial ends 14 and 16. The transmission line or cable 12 is rigid, and comprises an inner conductor 18 that may be a solid cylinder, and an outer conductor 20 that may be a hollow cylinder that is coaxial with and surrounds the inner conductor. Both conductors may be made of any metal conductor, such as aluminum for example, and they are separated by a space 22.

Referring now particularly to the coaxial switch 10, it is electrically connected through sleeves 11 to inner conductors 18 and to outer conductors 20 at ends 14 and 16 by multi-louvered, multi-contact material 24, such as "Multi-lam" manufactured by Multilam Corporation of California. This material has many spring contacts, and uses silver-plated beryllium copper to lessen contact resistance. The inner conductors are thus electrically connected through these multi-contact members which may be mounted in recesses in the switch members 26*a* and *b*. The outer conductors also are similarly electrically connected to outer switch members 28*a* and *b*. Both inner and outer members may be made of aluminum; for example. Spaces 30 are provided, between the ends 14 and 16 of the coaxial conductors and the switch members, for longitudinal expansion joints.

The inner member 25 of the switch 10 consist of two conductor switch members 26*a* and *b*, which are electrically insulated from one another by an insulating disc 32 interposed therebetween, and are fastened together through the disc by an insulated bolt 34. One or more insulated pins 36, perhaps in a circular pattern, traverse the insulating disc 32 and reside in holes in register in the inner members to preclude relative rotation.

The outer body member 27 consists of two cylindrical conductive switch members 28*a* and *b*, which are likewise electrically insulated from one another by a insulating ring 38 interposed therebetween, and are fastened together with a metal band or collar 40 surrounding the ring 38 and the members 28. The band collar is insulated from the members 28 by an insulating band 42, therebetween. The bands 38 and 40, and the outer members 28 are joined by metal bolts 44 around the periphery of the band collar, but insulated therefrom by bolt insulating washers 46. In the right outer switch members, 28*b*, as shown in the FIGS., a layer of insulation 50, is inlayed on the inner surface of the member 28*b*. On the outer surface of the right inner switch member 26*b*, as shown in the FIGS., there is inlayed a layer of insulation 48. These inlayed insulating layers or bands may be formed of an epoxy or any other appropriate material to obtain a flush wear resistant surface with the respective members.

The outer switch member 28*b*, at the right end, as viewed in the drawing, is axially held in fixed relation to the outer coaxial conductor 20, at end 16, by locating bolts 52 spaced around the periphery. The inner switch member 26*b* is axially held in fixed relation to the outer switch member 28*b*, at the right, by a group of insulated locating bolts 54 spaced around the right end periphery of switch member 26. Insulation spacers 56 radially separate the inner and outer switch members, and surround each bolt 54. Seals 58, such as for example "O"-rings, are provided between the outer switch members 28 and the outer coaxial conductor 20 at both ends.

A shuttle 60 is located between the inner members 26 and the outer members 28 of the switch and can slide axially between them, as shown, to a position of forward polarity in FIG. 2*a*, to off in FIG. 2*b*, and to reverse polarity in FIG. 2*c*, to be further explained hereinafter. The shuttle 60 is made up of three concentric cylinders. As shown in the FIGS., at the shuttle's right end is an inner cylinder 62 of conductive material and a concentric outer cylinder 64 of conductive material, both preferably made of copper or other good electrical conductor, separated by an insulating cylinder 66. An insulating collar 68 and a metal collar 70 are secured, by means of bolts 72 arranged in a circular pattern each with insulating washers 74, to ends of the cylinders 62 and 64. The inner cylinder has annular grooves on the inner surface for containing "Multilam" strips 24. The outer cylinder also has annular grooves on the outer surface for containing "Multilam" strips 24.

The shuttle 60, at its left end, as shown in the FIGS., has another set of cylinders comprising an inner cylinder 76 and a concentric outer cylinder 78, also both preferably made of copper or other good electrical conductor, separated by an insulating cylinder 80. A locating pin-screw, recessed in the outer cylinder, traverses the insulating cylinder and into the inner cylinder, but is insulated therefrom. The outer cylinder has two pairs of annular grooves on the outer diameter for containing "Multilam" strips 24, one pair on either side of the locating pin-screw. The inner cylinder 76, which is longer than the outer cylinder 78, has two groups of four annular grooves on the inner diameter for containing "Multilam" strips 24. The two groups of four annular grooves and "Multilam" strips are shown straddling the insulating disc 32. To the far left of the shuttle 60 is a floating insulating collar 82, preventing the shuttle from contacting the left outer conductor 20 or the left outer switch member 28*a*. The left inner cylinder 76 is electrically connected to the right outer cylinder 64 by a plurality of angularly mounted rods 84 preferably made of copper and brazed to cylinders 76 and 64. The left outer cylinders 78 is electrically connected to the right inner cylinder 62 by a plurality of rods 86 crisscrossing, but make no electrical contact with rods 84, and likewise brazed to cylinders 78 and 62.

The shuttle 60 is axially moved to various positions by linear actuators 85, (one shown) operated by fluid pressure or the like, having push rods and linkages 87. The actuator bodies are attached, as by bolts 88 to the outer switch member 28*b*, as shown and are insulated therefrom by insulating strips 90. The push rods and linkages 87 are attached to the shuttle 60, through a metal collar 70, which is secured to shuttle 60 by bolts 72 and is insulated therefrom by an insulating collar 68 and bolt washers 74. The push rods of the push rods and linkages 87 penetrate the ends of the outer switch member 28 through "O"-ring seals 58.

Figure 2A:
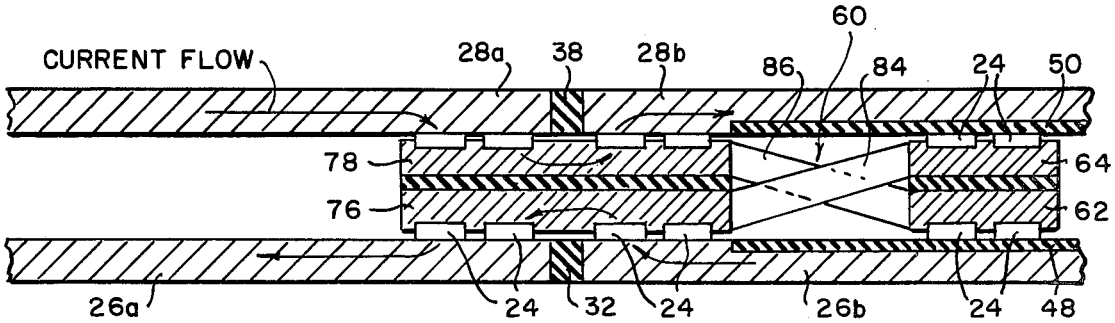
FIGS. 2*a*, 2*b*, and 2*c* show sectional views of the coaxial switch in forward, off, and reverse polarity positions.
Figure 2B:
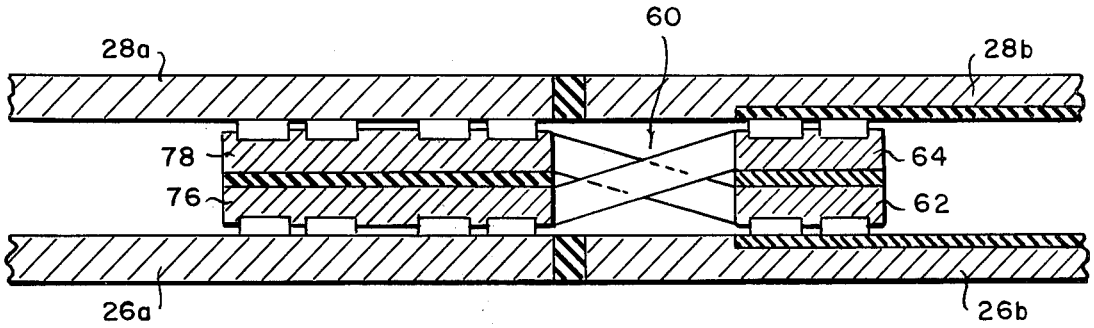
Figure 2C:
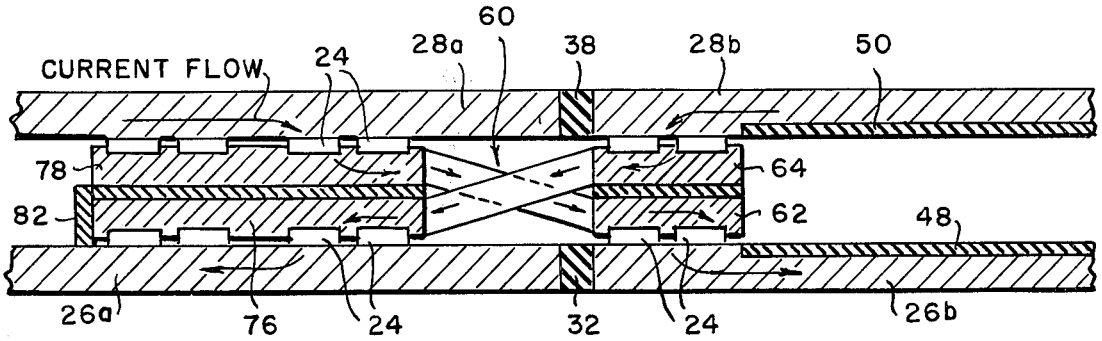

The operation of the coaxial, polarity reversing switch is best shown in FIGS. 2*a*, 2*b*, and 2*c*, which show schematically and in section that portion of the switch members and shuttle that ate detailed in FIG. 1. As can be seen, FIGS. 1 and 2a depict the shuttle 60 at the right end of its travel for forward polarity current transfer, that is there is no change in polarity between the inner and outer conductors 18 and 20. The current travels (shown by arrows) through the left outer switch member 28a, through one pair of the "Multilam" contacts 24, into and out of the left outer cylinder 78, through the other pair of "Multilam" contacts 24, and thence to the right outer switch member 28b, thus bridging the insulation ring 38. The right inner cylinder 62 has its contacts 24 against the insulating inlay 48, so no current flows to the right inner switch member 26 to cause a short circuit. The return current travels (shown by arrows) through the right inner switch member 26b, through one set of the "Multilam" contacts 24, into and out of the left inner cylinder 76, through the other set of "Multilam" contacts 24, and thence to the left inner switch member 26a, thus bridging the insulation disc 32. The right outer switch cylinder 64 has its contacts 24 against the insulating inlay 54, so no return current flows to the right outer switch member 28 to cause a short circuit.

Referring to FIG. 2b, where the switch is in the off position, the shuttle 60 has been moved to a central position to the left as viewed. Here the right inner cylinder 62 rests against the insulating inlay 48, so no contact is made with the right inner switch member 26b. Also the right outer cylinder 64 has its contacts resting against the insulating inlay 50, so no contact is made with the right outer switch member 28b. The shuttle left inner cylinder 76 now contacts only the left inner switch member 26a, and the left outer cylinder 78 now contacts only the left outer switch member 28a. Thus no current flows through the switch.

Referring to FIG. 2c, where the switch is in the reverse polarity position, the shuttle 60 has been moved to the extreme left as viewed, and is against the floating insulator 82 precluding short circuiting. At this shuttle position, the current travels (shown by arrows) through the left outer switch member 28a, through both pairs of the "Multilam" contacts 24, into the left outer cylinder 78, through the angular rods 86, and to the right inner cylinder 62. The current then flows through the both groups of "Multilam" contact strips 24, and thence into the right inner switch member 26b. Thus the forward current is transferred from the outer conductor sheath 20 of the coaxial cable to the inner conductor 18. The return current travels (shown by arrows) through the right outer switch member 28b, through both groups of "Multilam" 24 and into the right outer cylinder 64. Then continues through the cross rods 84 to the left inner cylinder 76, through both groups of "Multilam" 24, and thence into the left inner switch member 26. Thus the return current is transferred from the right outer conductor sheath 20 of the coaxial cable to the left inner conductor 18, reversing the polarity along the coaxial line 12 from the left end 14 to the right end 16.

The foregoing shuttle movement is performed by a plurality of linear actuators 85 (one shown), the body of which is insulatively connected to the outer switch member 28, and a push rod mechanism 87 is insulatively connected to the shuttle 60. The actuators 85 may be operated by fluid pressure, or any other feasible means to move the shuttle from the forward polarity position, through the off position, and to the reverse polarity position. The voids in the entire switch 10 and in the coaxial transmission line 12 may be filled with a non-conductive coolant which may be circulated and retained by the seals 58 to maintain low temperatures and to remove the heat generated by the $I^2R$ losses occuring in the switch.

Obviously, many modifications and variations of the present invention are possible in the light of the above teachings. It is therefore to be understood that within the scope of the appended claims, the invention may be practiced otherwise than as specifically described.

What is claimed is:

1. A coaxial line switch comprising:
a cylindrical switch body member;
means for connecting the switch to the outer conductor of the coaxial line;
means for connecting the switch to the inner conductor of the coaxial line;
means coaxially mounted within said body member for selectively connecting, disconnecting and interconnecting the conductors of the coaxial line to control the flow of current through each of the conductors.

2. A switch as claimed in claim 1 in which said body is composed of two conductive cylinders separated by an insulating ring;
means for holding said cylinders and said ring together to form said cylindrical body.

3. A switch as claimed in claim 2 in which said means connecting said switch to the outer conductor include sleeves on said two conductive cylinders;
said sleeves being connected to respective ends of the outer conductor of the coaxial line.

4. A switch as claimed in claim 3 in which said means mounted within said body includes an inner conductor mounted coaxially of said body;
said inner conductor consisting of two conductor suctions separated by a insulating section.

5. A switch as claimed in claim 4 in which means for connecting said switch to said inner conductor includes means carried by said sections for connection to respective ends of the inner conductor of the coaxial line.

6. A switch as claimed in claim 1 in which said means within said body includes a sliding member for selectively controlling the current flow between the respective inner conductors, the respective outer conductors and between the inner and outer conductors.

7. A switch as claimed in claim 6 in which said sliding member is comprised of a pair of concentric cylinders of conductive material radially separated by a concentric cylinder of an insulating material;
a plurality of conductive bars cross-connecting the adjacent ends of said pair of cylinders;
said bars being spaced from each other.

8. A switch as claimed in claim 7 in which one of said conductive body cylinders includes an insulating inlay partially covering a portion of the inner surface of said body cylinder;
said insulating inlay being positioned to break contact between the outer of said concentric cylinders of said sliding member and said one of said conductive body cylinders in one position of said sliding member.

9. A switch as claimed in claim 8 in which one of said conductive sections includes an insulating inlay on a portion of its outer surface, said inlay being positioned on the said section in coaxial relation to the inlay on the body cylinder and substantially coextensive therewith.

10. A switch as claimed in claim 1 which includes:
means to actuate said means mounted within said body.

11. A switch as claimed in claim 10 in which said means within said body includes a sliding member;
linkage means for interconnecting said sliding member and said actuating means.

* * * * *